US010221564B2

(12) United States Patent
Mei

(10) Patent No.: US 10,221,564 B2
(45) Date of Patent: Mar. 5, 2019

(54) FAST-ASSEMBLING FIXED DOOR INSTALLATION STRUCTURE FOR SHOWER ROOM

(71) Applicant: WUXI ASANAS SANITARY WARE & EQUIPMENT Co., LTD., Wuxi (CN)

(72) Inventor: Yuhua Mei, Wuxi (CN)

(73) Assignee: WUXI ASANAS SANITARY WARE & EQUIPMENT Co., LTD., Wuxi (CN)

( * ) Notice: Subject to any disclaimer, the term of this patent is extended or adjusted under 35 U.S.C. 154(b) by 0 days.

(21) Appl. No.: 15/551,987

(22) PCT Filed: Feb. 16, 2016

(86) PCT No.: PCT/CN2016/073886

§ 371 (c)(1),
(2) Date: Nov. 21, 2017

(87) PCT Pub. No.: WO2016/169325

PCT Pub. Date: Oct. 27, 2016

(65) Prior Publication Data

US 2018/0163400 A1 Jun. 14, 2018

(30) Foreign Application Priority Data

Apr. 20, 2015 (CN) ..... 2015 1 0188799

(51) Int. Cl.

| | |
|---|---|
| ***E04B 2/74*** | (2006.01) |
| ***A47K 3/30*** | (2006.01) |
| ***E04B 2/76*** | (2006.01) |

(52) U.S. Cl.

CPC ..... *E04B 2/7416* (2013.01); *A47K 3/30* (2013.01); *E04B 2/76* (2013.01); *E04B 2002/7477* (2013.01)

(58) Field of Classification Search

USPC ..... 52/126.1, 126.3, 127.7, 282.4, 659.6

See application file for complete search history.

(56) References Cited

U.S. PATENT DOCUMENTS 3,018,861 A * 1/1962 Somville ..... E06B 3/9688 403/401
3,553,891 A * 1/1971 Casebolt ..... A47K 3/36 49/505

(Continued)

FOREIGN PATENT DOCUMENTS

AU 2013100475 A4 5/2013
CN 201339416 Y 4/2009

(Continued)

OTHER PUBLICATIONS

International Search Report, dated Mar. 31, 2016, for PCT Application No. PCT/CN2016/073886, filed Feb. 16, 2016.

*Primary Examiner* — Brian E Glessner
*Assistant Examiner* — Adam G Barlow
(74) *Attorney, Agent, or Firm* — Barnes & Thornburg LLP; Jeffrey Stone

(57) ABSTRACT

A fast-assembling fixed door installation structure for a shower room includes one aluminum profile against a wall, a guide rail, a fixed door and a guide rail connecting assembly. The aluminum profile against the wall has a cavity, and is provided with a first notch along a height direction at an inner side thereof for mounting the fixed door. The guide rail connecting assembly includes a wall connector and a guide rail connector, which have an integral structure. The guide rail connector is provided on one side of the wall connector. The wall connector is installed within the cavity of the aluminum profile against the wall. The guide rail is provided with an installing groove matching with the profile of the guide rail connector.

9 Claims, 11 Drawing Sheets

(56) References Cited

U.S. PATENT DOCUMENTS

| | | | | | |
|---|---|---|---|---|---|
| 5,478,036 | A * | 12/1995 | Wu | A47B 83/001 | 248/220.22 |
| 5,647,172 | A * | 7/1997 | Rokicki | E06B 3/20 | 160/381 |
| 6,792,721 | B1 * | 9/2004 | Montanari | A47K 3/36 | 4/612 |
| 7,877,825 | B1 * | 2/2011 | Marshall | A47K 3/30 | 4/612 |
| 2004/0221384 | A1 * | 11/2004 | Tavivian | A47K 3/30 | 4/596 |
| 2009/0241610 | A1 * | 10/2009 | Watts | E06B 3/9643 | 70/91 |
| 2014/0115773 | A1 * | 5/2014 | Wei | A47K 3/30 | 4/607 |
| 2014/0237715 | A1 * | 8/2014 | Wei | A47K 3/30 | 4/607 |
| 2014/0237903 | A1 * | 8/2014 | Wei | A47K 3/30 | 49/504 |
| 2014/0250795 | A1 * | 9/2014 | Wei | A47K 3/30 | 49/505 |
| 2014/0331564 | A1 * | 11/2014 | Wei | A47K 3/30 | 49/505 |
| 2015/0191963 | A1 * | 7/2015 | Wei | E06B 1/52 | 49/505 |

FOREIGN PATENT DOCUMENTS

| | | | |
|---|---|---|---|
| CN | 202970320 | U | 6/2013 |
| CN | 203175266 | U | 9/2013 |
| CN | 203308297 | U | 11/2013 |
| CN | 104806126 | A | 7/2015 |
| CN | 204703688 | U | 10/2015 |
| SE | 529220 | C2 | 5/2006 |

* cited by examiner

FAST-ASSEMBLING FIXED DOOR INSTALLATION STRUCTURE FOR SHOWER ROOM

This application claims priority to a Chinese patent application No. 201510188799.6, filed on Apr. 20, 2015, filed by YuHua Mei, and entitled "FAST-ASSEMBLING FIXED DOOR INSTALLATION STRUCTURE FOR SHOWER ROOM", the disclosure of which is incorporated herein by reference in entirety.

TECHNICAL FIELD

The present disclosure relates to a shower room, in particular, to a fast-assembling fixed door installation structure for a shower room.

BACKGROUND

A shower room is common sanitary facilities in modern home at present. As shown FIGS. 1 to 3, a fixed door installation structure for the existing shower room includes an aluminum profile 10 against a wall, a fixed door mounting aluminum profile 11 and a guide rail 12. The fixed door 13 is installed at the fixed door mounting aluminum profile 11 by glue and a special equipment, the guide rail 12 is fixedly connected at the mounting aluminum profile 11 for the fixed door using connecting screws 14, and the aluminum profile 10 against the wall is fixed with the fixed door mounting aluminum profile 11 by a positioning screw 15 mounting at one side of the aluminum profile 10 against the wall. The disadvantages of the fixed door installation structure lie in that:

1. the fixed door installation structure needs both the aluminum profile against the wall and the fixed door mounting aluminum profile, has a complex structure and high cost;
2. the guide raid needs to be connected by the connecting screws after punching at the fixed door mounting aluminum profile, and the connections between two aluminum profiles needs to be fixed by the positioning screw after punching, causing a complicated installation operation, a high labor cost and low installation efficiency;
3. the fixed door needs to be installed at the fixed door mounting aluminum profile by glue and the special equipment before leaving the factory, and thus the fixed door is not easy to be installed and transported;
4. the fixed door installation structure has an unsightly appearance, and more than two screws are visible on the aluminum profile against the wall viewed from the interior of the shower room.

SUMMARY

The present disclosure is to provide a fast-assembling fixed door installation structure for a shower room, which is easy to be installed, has a simple structure and low cost, to solve the above problems in the existing the fixed door installation structure for the shower room.

For this purpose, the present disclosure adopts the following solutions.

A fast-assembling fixed door installation structure for a shower room includes an aluminum profile against a wall, a guide rail, a fixed door and a guide rail connecting assembly, wherein the aluminum profile against the wall is provided with a first notch along a height direction at an inner side thereof, the guide rail connecting assembly includes a wall connector and a guide rail connector, the wall connector is installed within a cavity of the aluminum profile against the wall, the guide rail is provided with an installing groove matching with the guide rail connector, the guide rail connector is inserted into the installing groove to connect the guide rail connecting assembly with the guide rail, a limit assembly is disposed on the wall connector for preventing the guide rail connecting assembly from moving upward, second notches are disposed at an upper end and a lower end of the first notch on the aluminum profile against the wall, respectively, for facilitating the installation of the guide rail.

An adjusting and positioning assembly is disposed on the guide rail for adjusting the guide rail along the guide rail connector.

Each of the second notches is provided with respective one of fittings.

The limit assembly includes a limit bolt, two bosses are symmetrically disposed at a bottom of the limit bolt, a limit hole is disposed within the wall connector and the cavity of the aluminum profile against the wall for matching with the limit bolt, the wall connector is integrally molded using plastic, there is a gap between the wall connector and the aluminum profile against the wall after installing the wall connector, the wall connector is expanded outward to tightly cling to the cavity of the aluminum profile against the wall after installing the limit bolt into a suitable position.

The limit assembly includes a limit screw and a limit threaded hole matching with the limit screw.

The limit assembly includes a limit buckled head disposed at one side of the wall connector, and a buckling hole disposed on the aluminum profile against the wall for matching with the limit buckled head, the buckled head is bucked into the buckling hole after installing the wall connector into a suitable position.

The limit threaded hole is disposed within the cavity of the aluminum profile against the wall, there is a gap between the wall connector and the aluminum profile against the wall after installing the wall connector, the wall connector is expanded outward to tightly cling to the cavity of the aluminum profile against the wall after screwing the limit screw into the limit threaded hole.

The limit threaded hole consists of two parts, one part of which is disposed within the cavity of the aluminum profile against the wall while the other part of which is disposed on the wall connector, there is a gap between the wall connector and the aluminum profile against the wall after installing the wall connector, the wall connector is expanded outward to tightly cling to the cavity of the aluminum profile against the wall after screwing the limit screw into the limit threaded hole.

The adjusting and positioning assembly includes a base, a positioning base, a threaded hole, a positioning screw, and a decorative cap, the base is arranged to be matched with a cross section of the installing groove of the guide rail and extends at the side thereof to form the positioning base provided with the threaded hole, the base is inserted into the installing groove of the guide rail and the positioning screw passes through the threaded hole to press tightly an inner wall of the guide rail, the decorative cap is disposed outside of the positioning screw.

One side of the first notch extends inwardly into the cavity of the aluminum profile against the wall to form a turnup, anti-sliding teeth are provided on a surface of the turnup contacting with the fixed door.

The wall connector is fixed within the cavity of the aluminum profile against the wall by glue.

The beneficial effects of the present disclosure lie in that the fixed door installation structure for the shower room has the following advantages compared to the prior art.

1. The fixed door installation structure for the shower room only adopts one profile, and has a simple structure and low cost;

2. The guide rail is connected with the aluminum profile against a wall by a guide rail connecting assembly, causing an easy and fast installation;

3. The fixed door installation structure has s simple structure, may be installed on-site and is thus easy to installed and transported;

4) The entire shower room has an attractive and smooth appearance, and there is no screws viewed from the surface of the aluminum profile against the wall.

DETAILED DESCRIPTION OF THE EMBODIMENT

The technical solution of the present disclosure will be further described in details below in combination with the accompanying drawings and the embodiments.

Figure 1:
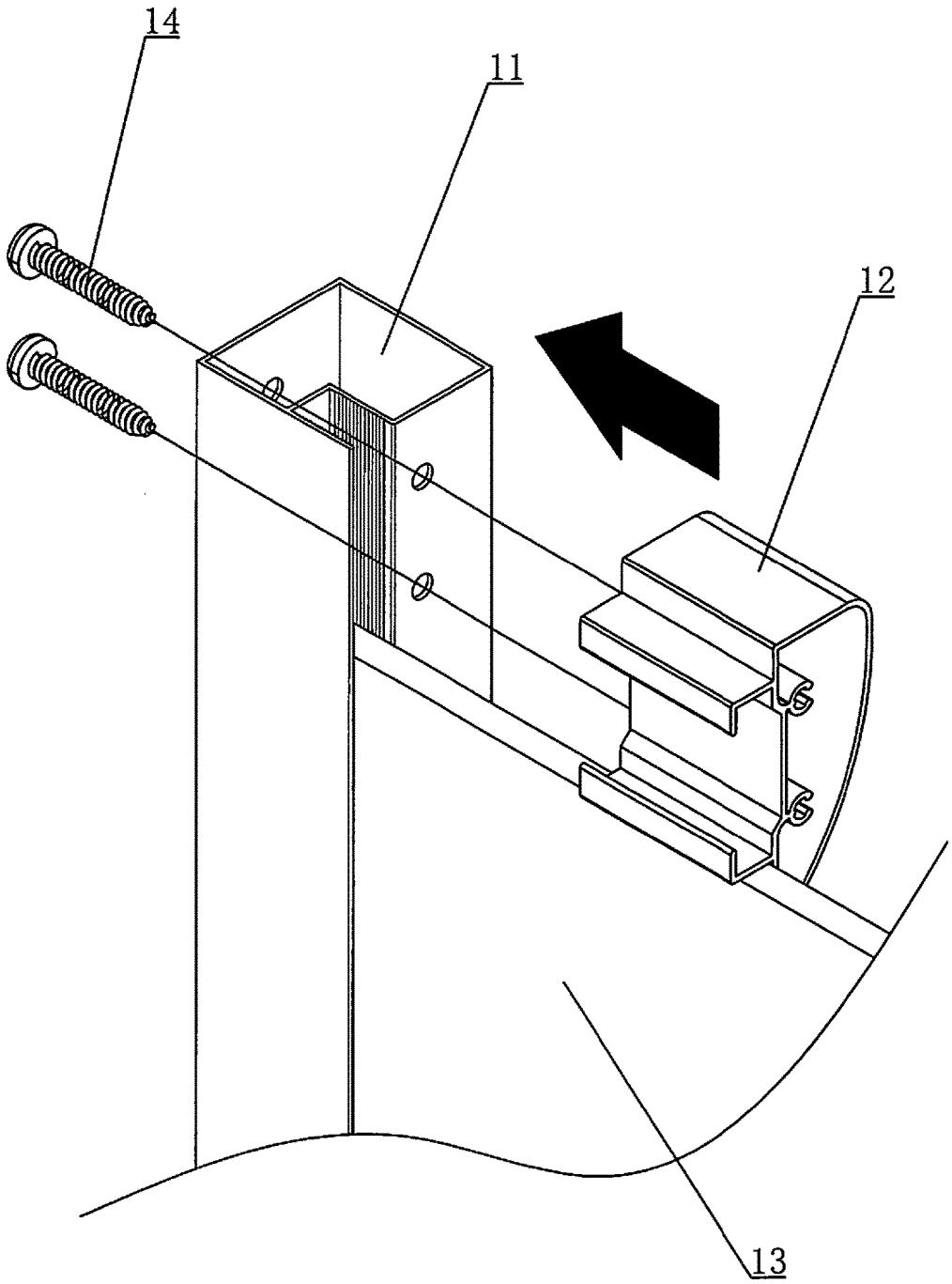
FIG. 1 is a diagram view showing an installation of a fixed door and a fixed door mounting aluminum profile of an existing fixed door installation structure.
Figure 2:
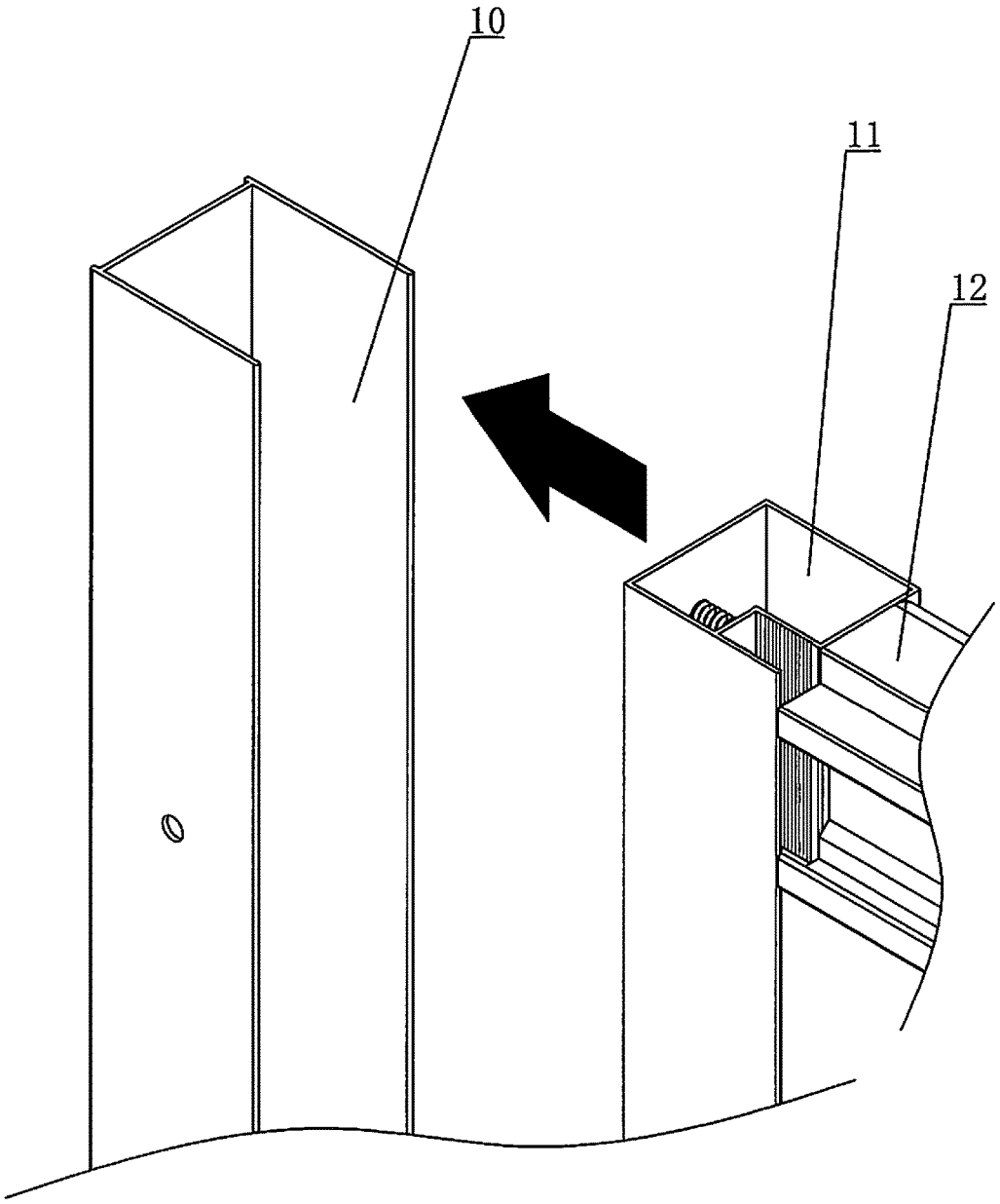
FIG. 2 is an exploded view of the existing fixed door installation structure.
Figure 3:
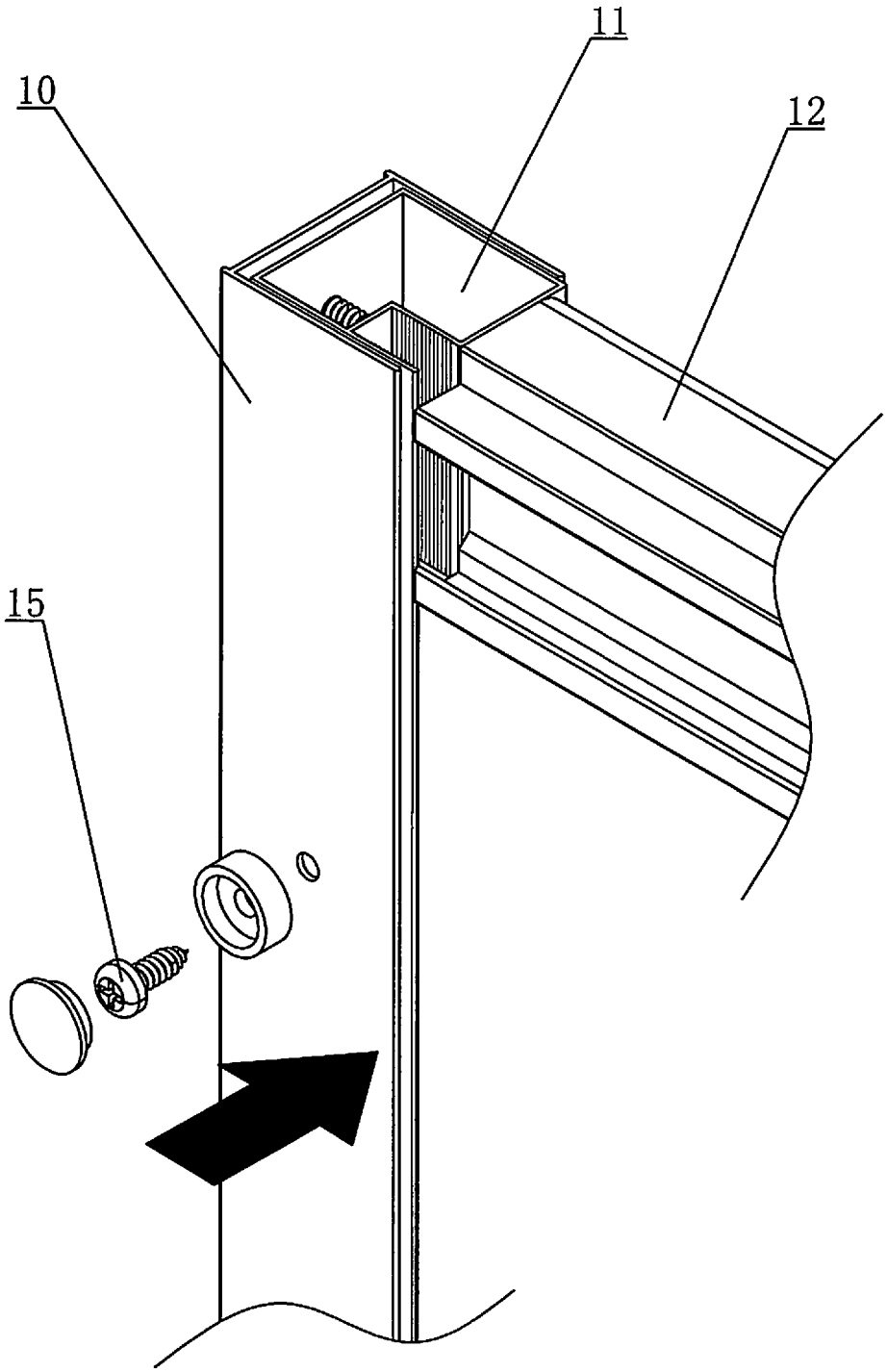
FIG. 3 is an assembly view of the existing fixed door installation structure.
Figure 4:
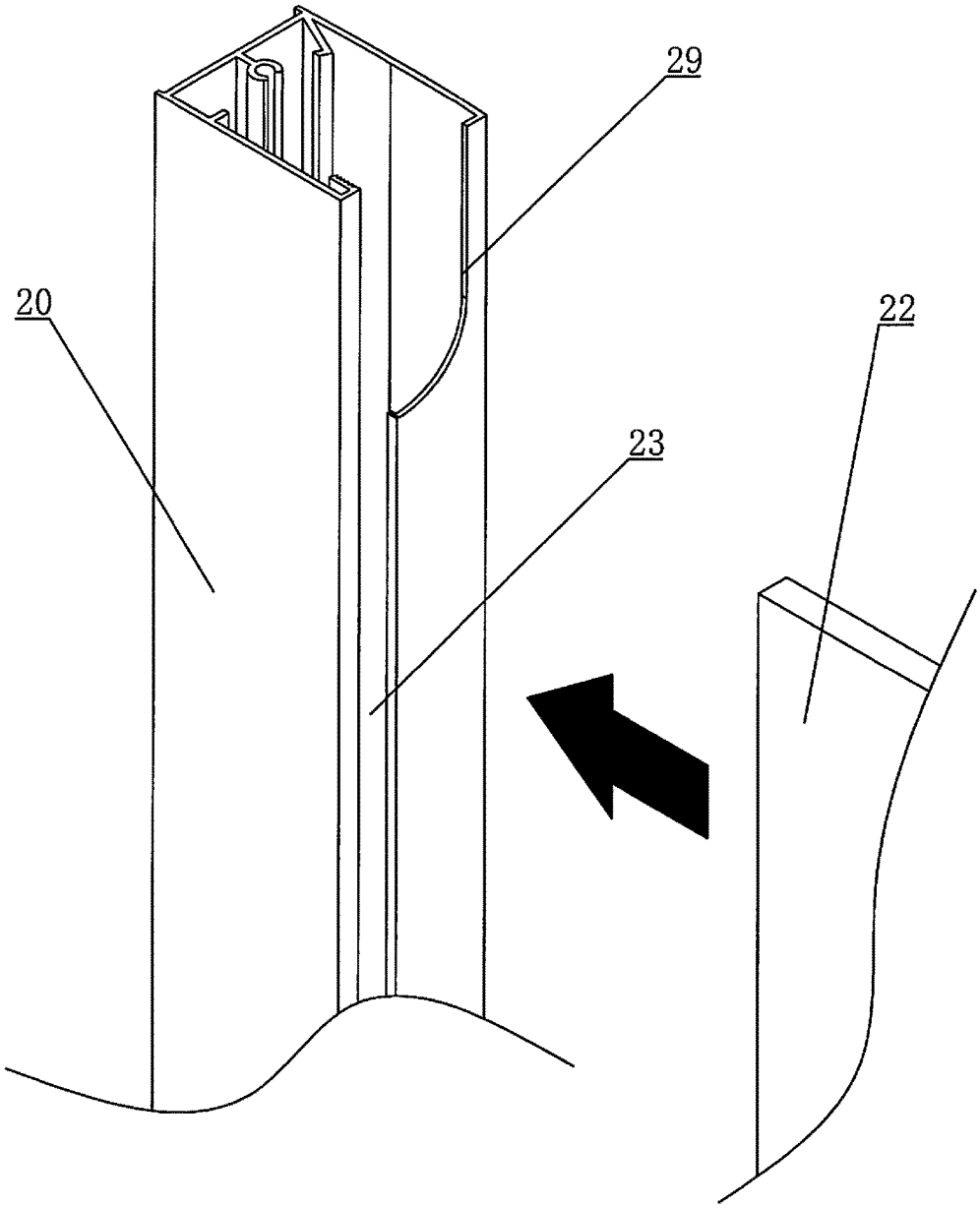
FIG. 4 is a diagram view showing an installation of a fixed door of a fast-assembling fixed door installation structure for a shower room provided by an embodiment of the present disclosure.
Figure 5:
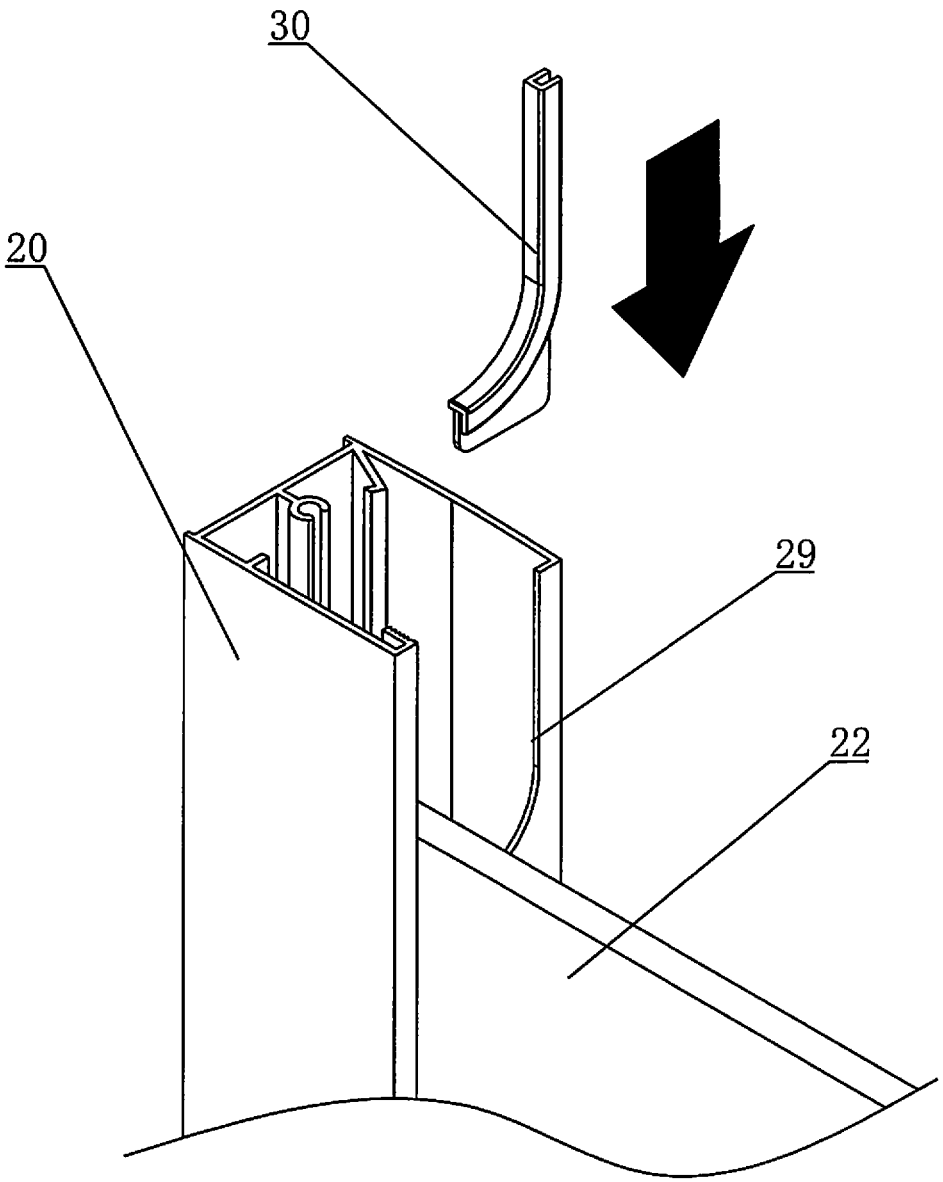
FIG. 5 is a diagram view showing an installation of a fitting of a fast-assembling fixed door installation structure for a shower room provided by the embodiment of the present disclosure.
Figure 6:
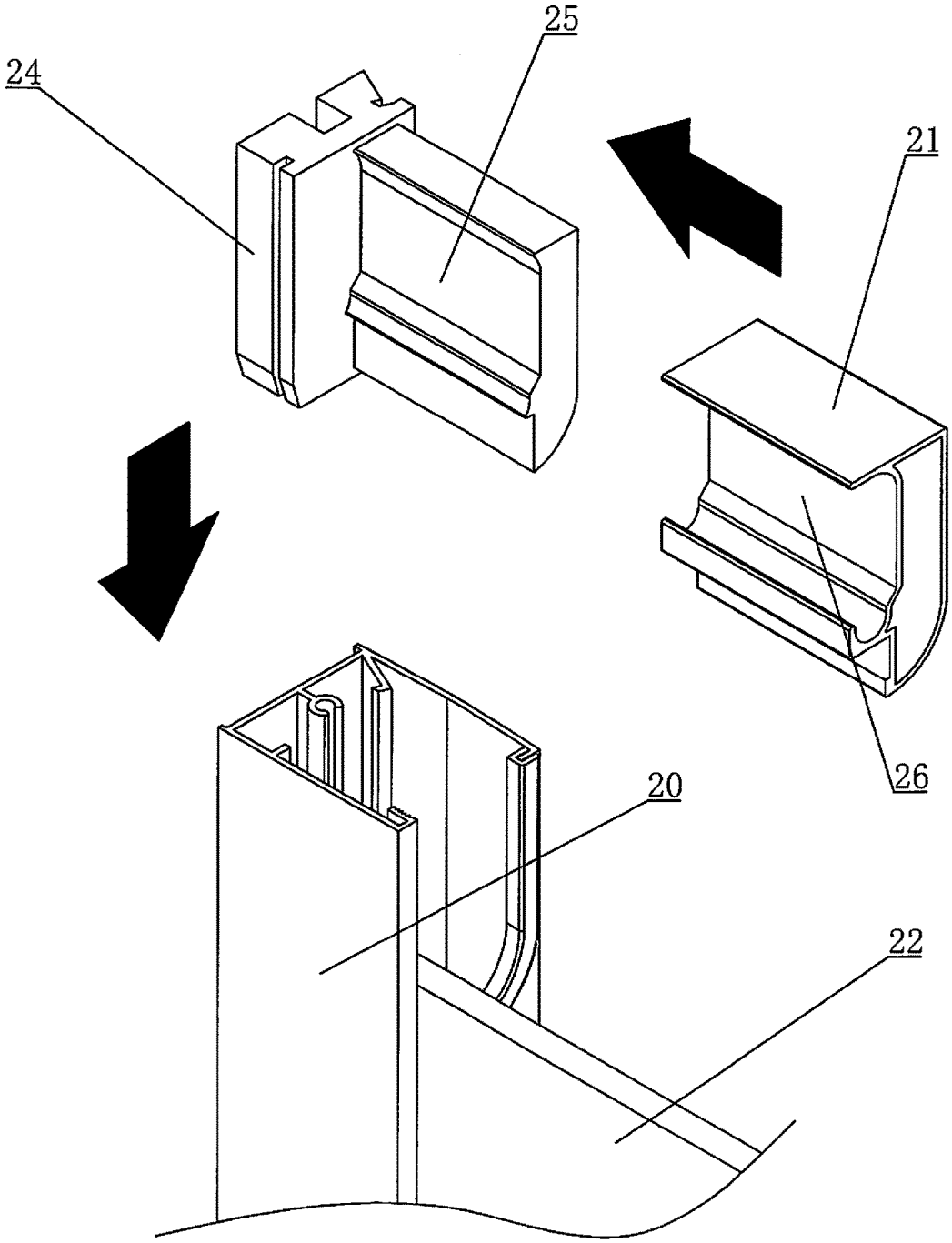
FIG. 6 is a diagram view showing an installation of a guide rail connecting assembly of a fast-assembling fixed door installation structure for the shower room provided by the embodiment of the present disclosure.
Figure 7:
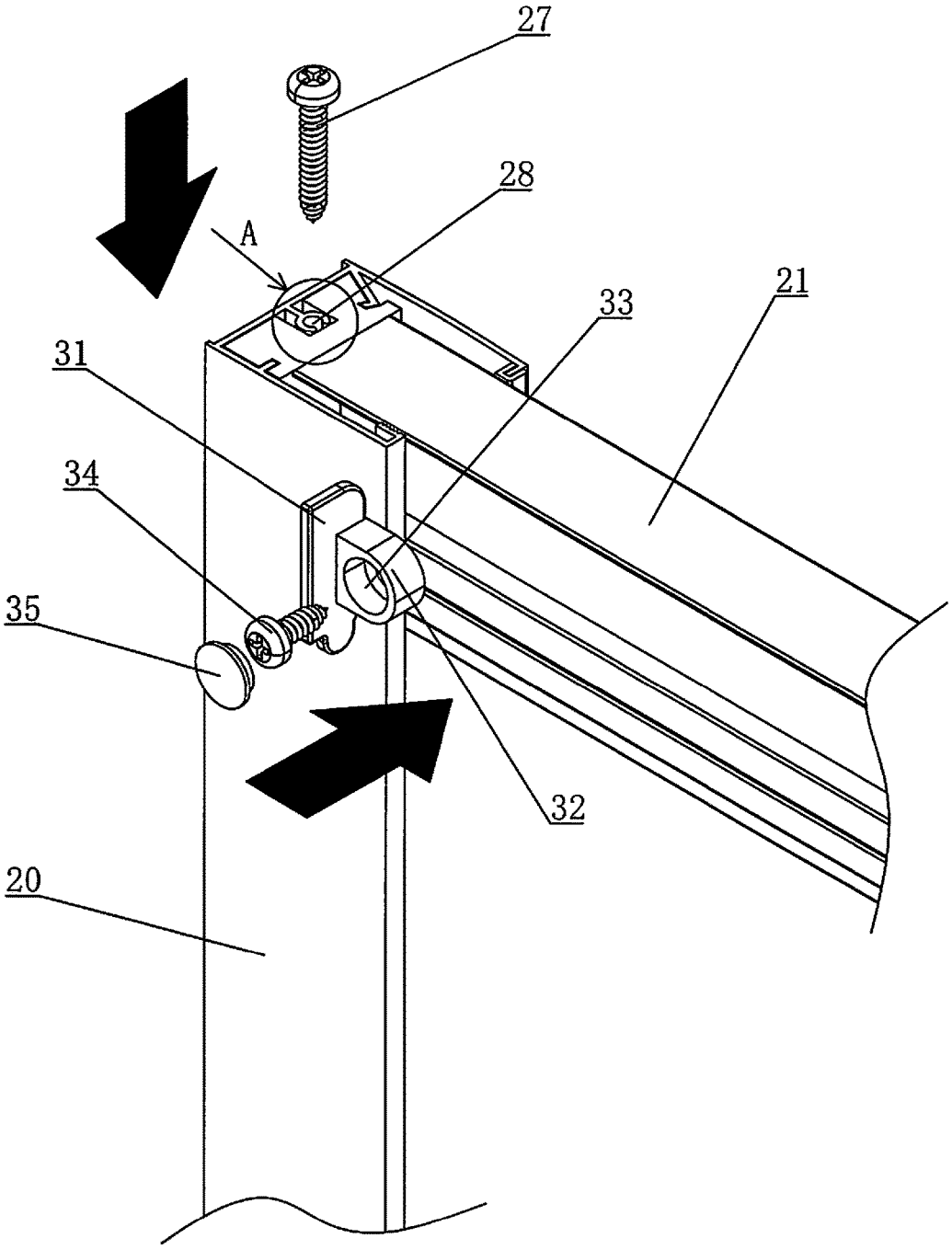
FIG. 7 is a diagram view showing an installation of a limit assembly and a adjusting and positioning assembly of a fast-assembling fixed door installation structure for the shower room provided by the embodiment of the present disclosure.
Figure 8:
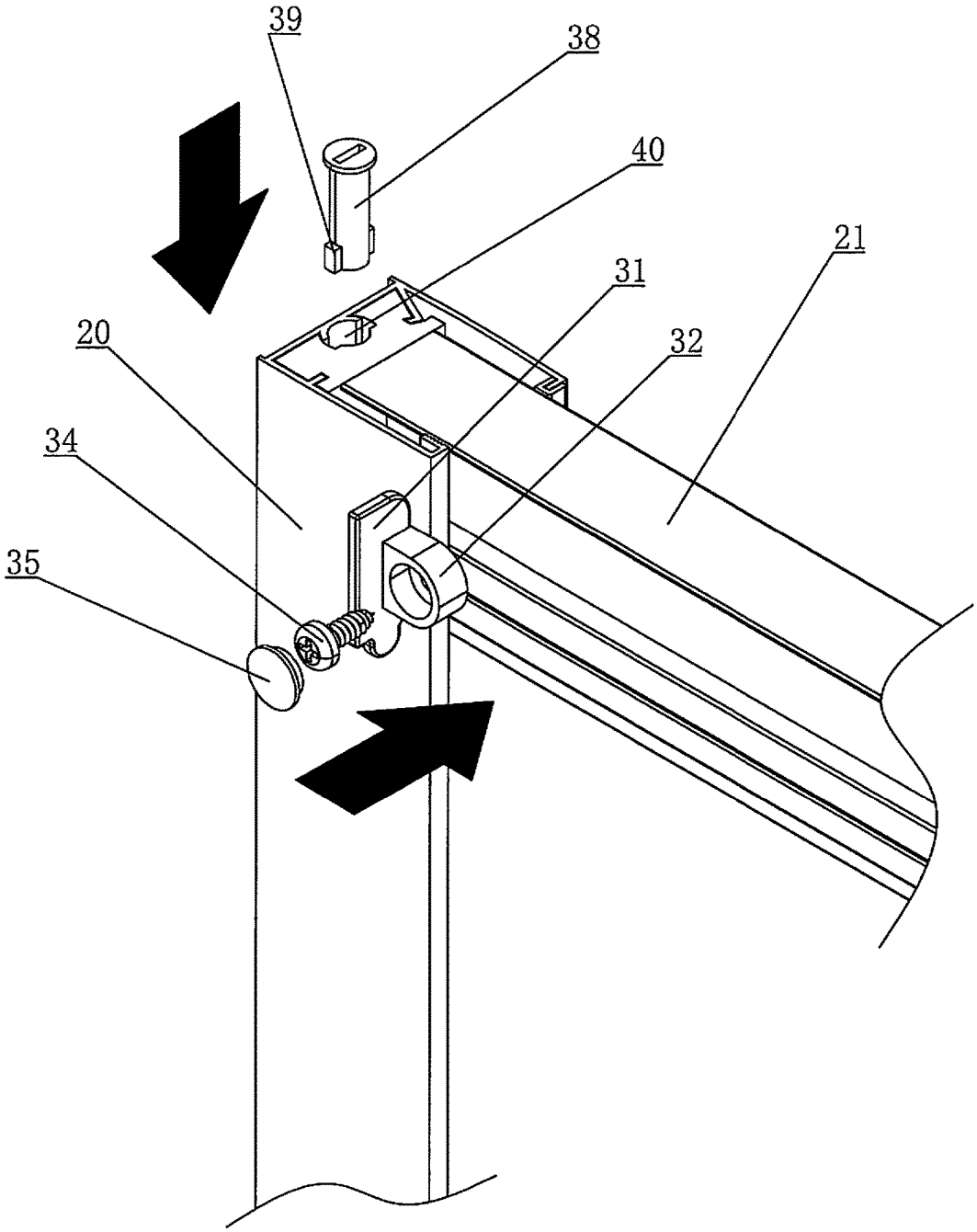
FIG. 8 is a diagram view showing the structure of another limit assembly of a fast-assembling fixed door installation structure for the shower room provided by the embodiment of the present disclosure.
Figure 9:
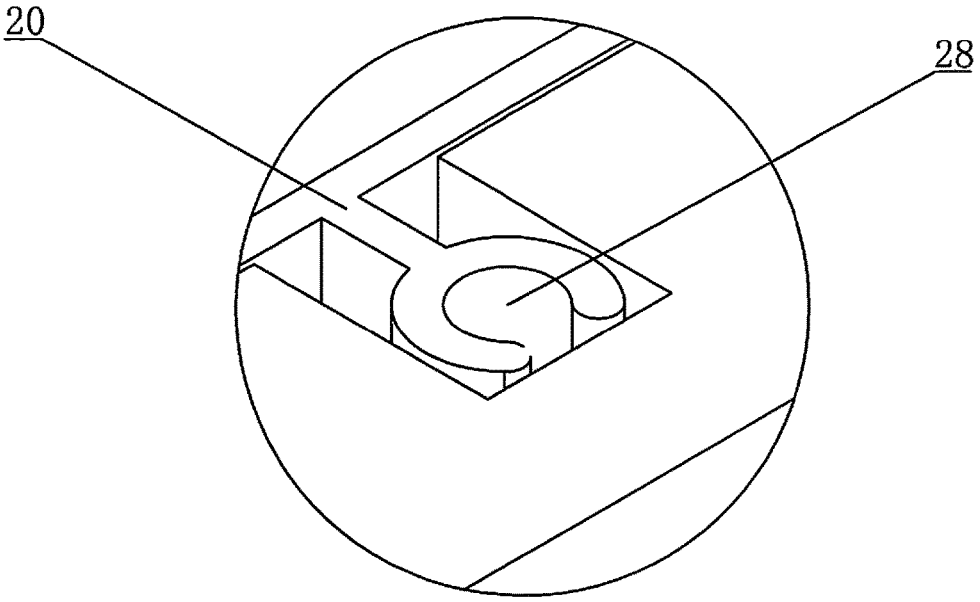
FIG. 9 is a partially enlarged view at the position A shown in FIG. 7.
Figure 10:
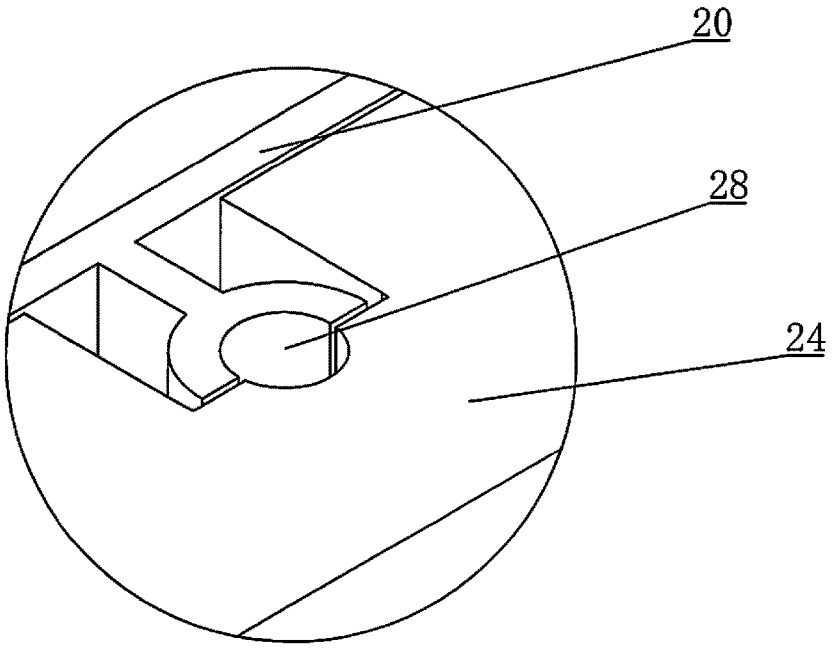
FIG. 10 is a diagram view showing the structure of another limit threaded hole of a fast-assembling fixed door installation structure for the shower room provided by the embodiment of the present disclosure.
Figure 11:
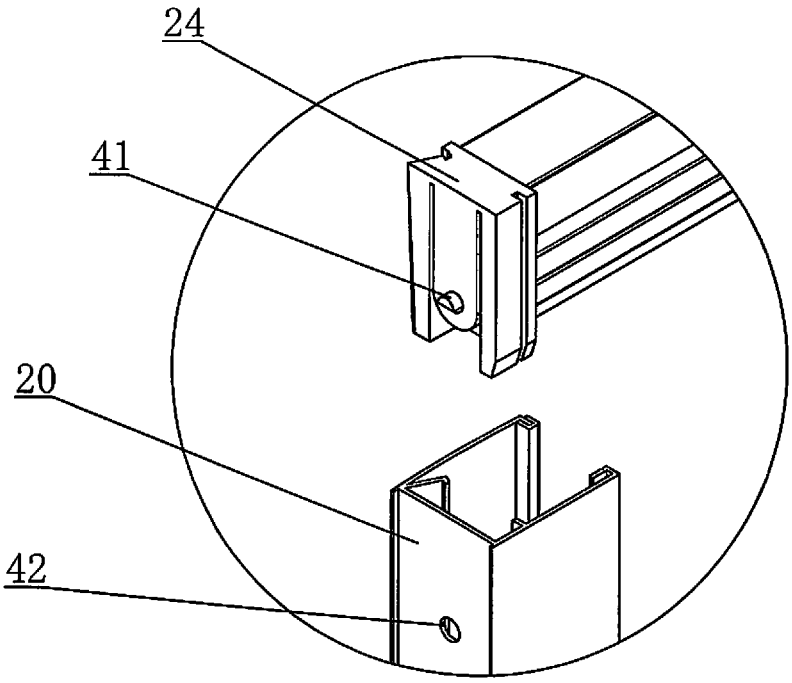
FIG. 11 is a diagram view showing the structure of still another limit assembly of a fast-assembling fixed door installation structure for the shower room provided by the embodiment of the present disclosure.
Figure 12:
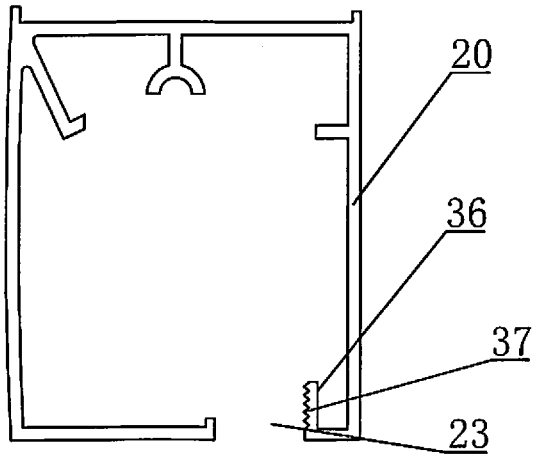
FIG. 12 is a diagram view showing an installation of an aluminum profile against a wall of a fast-assembling fixed door installation structure for the shower room provided by the embodiment of the present disclosure.
Figure 13:
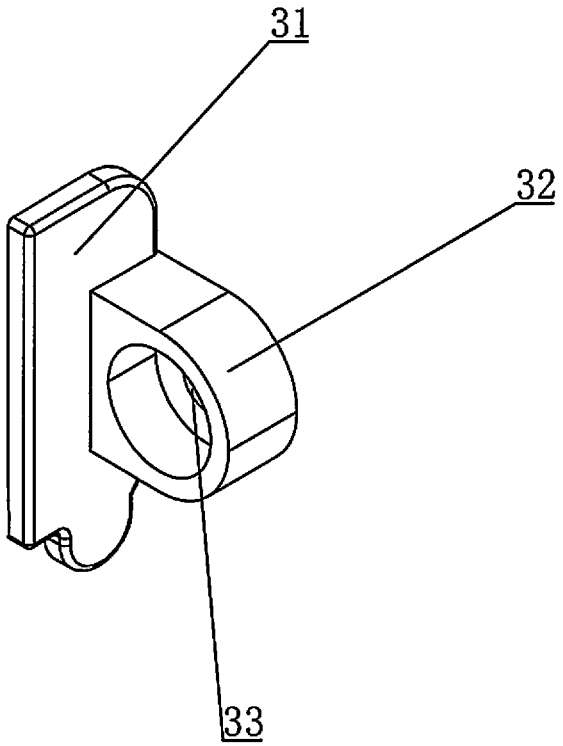
FIG. 13 is a diagram view showing an installation of the adjusting and positioning assembly of a fast-assembling fixed door installation structure for the shower room provided by the embodiment of the present disclosure.

As shown is FIGS. 4 to 13, in the present embodiment, a fast-assembling fixed door installation structure for a shower room includes an aluminum profile 20 against a wall, a guide rail 21, a fixed door 22 and a guide rail connecting assembly. The aluminum profile 20 against the wall has a cavity, and is provided with a first notch 23 along a height direction at an inner side thereof. The fixed door 22 is inserted into the aluminum profile 20 against the wall through the first notch 23 and is fixed by a unilateral belt. The guide rail connecting assembly is integrally molded using plastic injection. The guide rail connecting assembly includes a wall connector 24 and a guide rail connector 25, the wall connector is installed within the cavity of the aluminum profile 20 against the wall, the guide rail connector 25 is provided on one side of the wall connector 24. The guide rail 21 is provided with an installing groove 26 matching with the guide rail connector 25, such that the guide rail connector 25 is inserted into the installing groove 26 to connect the guide rail connecting assembly with the guide rail 21. A limit assembly is disposed on the wall connector 24 for preventing the guide rail connecting assembly from moving upward, and includes a limit screw 27 and a limit threaded hole 28 matching with the limit screw 27. The threaded hole 28 may be designed to be disposed within the cavity of the aluminum profile 20 against the wall. The threaded hole 28 may also be designed to consist of two parts, one part of which is disposed within the cavity of the aluminum profile 20 against the wall while the other part of which is disposed on the wall connector 24. There is a gap between the wall connector 24 and the aluminum profile 20 against the wall after installing the wall connector 24. The limit screw 27 is screwed into the limit threaded hole 28 to expand it outward such that the wall connector 24 is in turn forced to be expand outward to tightly cling to the cavity of the aluminum profile 20 against the wall.

Second notches 29 are disposed at the upper and lower ends of the first notch 23 on the aluminum profile 20 against the wall, respectively, for facilitating the installation of the guide rail. Each of the second notches 29 is provided with respective one of fittings 30.

An adjusting and positioning assembly is disposed on the guide rail 21 for adjusting the guide rail 21 along the guide rail connector 25 and includes a base 31, a positioning base 32, a threaded hole 33, a positioning screw 34, and a decorative cap 35. The base 31 is arranged to be matched with the cross section of the installing groove 26 of the guide rail 21 and extends at the side thereof to faun the positioning base 32 provided with the threaded hole 33. The base 31 is inserted into the installing groove 26 of the guide rail 21 and the positioning screw 34 passes through the threaded hole 33 to press tightly an inner wall of the guide rail 21. The decorative cap 35 is disposed outside of the positioning screw 34.

One side of the first notch 23 extends inwardly into the cavity of the aluminum profile 20 against the wall to faun a turnup 36. Anti-sliding teeth 37 are provided on the surface of the turnup 36 contacting with the fixed door 22.

Referring to FIG. 8 again, the limit assembly includes a limit bolt 38, two bosses 39 are symmetrically disposed at the bottom of the limit bolt. A limit hole 40 is disposed within the wall connector 24 and the cavity of the aluminum profile 20 against the wall for matching with the limit bolt 38. There is a gap between the wall connector 24 and the aluminum profile 20 against the wall after installing the wall connector 24. The limit bolt 38 is positioned by the rotation after being inserted into the limit hole 40 to expand it outward such that the wall connector 24 is in turn forced to be expand outward to tightly cling to the cavity of the aluminum profile 20 against the wall.

Referring to FIG. 11 again, the limit assembly includes a limit buckled head 41 disposed at one side of the wall connector 24, and a buckling hole 42 disposed on the aluminum profile 20 against the wall for matching with the limit buckled head 41.

Certainly, the wall connector 24 is immediately fixed within the cavity of the aluminum profile 20 against the wall by glue.

When installing the shower room, the fixed door 22 is firstly inserted into the aluminum profile 20 against the wall through the first notch 23 and is fixed by a unilateral belt, the wall connector 24 is then inserted into the cavity of the aluminum profile 20 against the wall, and the guide rail 21 is positioned by the positioning screw 34 after the guide rail 21 is connected to the guide rail connector 25 to be adjusted into a suitable position, the limit assembly is finally installed on the wall connector 24.

It should be understood that the specific embodiments described above are merely for illustrating the basic principle and characterize of the present disclosure but not for limiting the present disclosure. The various alterations and modifies falling within the scope of the present disclosure sought to be claimed may be made out without departing from the spirit and protection scope of the present disclosure. The scope of the present disclosure is determined by the scope of the appended claims and the equivalent thereof.

I claim:

1. A fast-assembling fixed door installation structure for a shower room, comprising an aluminum profile against a wall, a guide rail, a fixed door and a guide rail connecting assembly, wherein the aluminum profile against the wall is provided with a first notch along a height direction at an inner side thereof for mounting the fixed door, the guide rail connecting assembly comprises a wall connector and a guide rail connector, the wall connector is installed within a cavity of the aluminum profile against the wall, the guide rail is provided with an installing groove matching with the guide rail connector, the guide rail connector is inserted into the installing groove to connect the guide rail connecting assembly with the guide rail, a limit assembly is disposed on the wall connector for preventing the guide rail connecting assembly from moving upward, second notches are disposed at an upper end and a lower end of the first notch on the aluminum profile against the wall, respectively, for facilitating the installation of the guide rail, wherein the limit assembly comprises a limit bolt, two bosses are symmetrically disposed at a bottom of the limit bolt, a limit hole is disposed within the wall connector and the cavity of the aluminum profile against the wall for matching with the limit bolt, the walls connector is integrally molded using plastic, there is a gap between the wall connector and the aluminum profile against the wall after installing the wall connector, the wall connector is expanded outward to tightly cling to the cavity of the aluminum profile against the wall after installing the limit bolt into a suitable position.

2. The fast-assembling fixed door installation structure for the shower room of claim 1, wherein an adjusting and positioning assembly is disposed on the guide rail for adjusting the guide rail along the guide rail connector.

3. The fast-assembling fixed door installation structure for the shower room of claim 1, wherein each of the second notches is provided with a fitting.

4. The fast-assembling fixed door installation structure for the shower room of claim 1, wherein the limit assembly comprises a limit screw and a limit threaded hole matching with the limit screw.

5. The fast-assembling fixed door installation structure for the shower room of claim 1, wherein the limit assembly comprises a limit buckled head disposed at one side of the wall connector, and a buckling hole disposed on the aluminum profile against the wall for matching with the limit buckled head, the buckled head is bucked into the buckling hole after installing the wall connector into a suitable position.

6. The fast-assembling fixed door installation structure for the shower room of claim 4, wherein the limit threaded hole is disposed within the cavity of the aluminum profile against the wall, there is a gap between the wall connector and the aluminum profile against the wall after installing the wall connector, the wall connector is expanded outward to tightly cling to the cavity of the aluminum profile against the wall after screwing the limit screw into the limit threaded hole.

7. The fast-assembling fixed door installation structure for the shower room of claim 4, wherein the limit threaded hole consists of two parts, one part of which is disposed within the cavity of the aluminum profile against the wall while the other part of which is disposed on the wall connector, there is a gap between the wall connector and the aluminum profile against the wall after installing the wall connector, the wall connector is expanded outward to tightly cling to the cavity of the aluminum profile against the wall after screwing the limit screw into the limit threaded hole.

8. The fast-assembling fixed door installation structure for the shower room of claim 2, wherein the adjusting and positioning assembly comprises a base, a positioning base, a threaded hole, a positioning screw, and a decorative cap, the base is arranged to be matched with a cross section of the installing groove of the guide rail and extends at the side thereof to form the positioning base provided with the threaded hole, the base is inserted into the installing groove of the guide rail and the positioning screw passes through the threaded hole to press tightly an inner wall of the guide rail, the decorative cap is disposed outside of the positioning screw.

9. The fast-assembling fixed door installation structure for the shower room of claim 1, wherein one side of the first notch extends inwardly into the cavity of the aluminum profile against the wall to form a turnup, anti-sliding teeth are provided on a surface of the turnup contacting with the fixed door.

* * * * *